United States Patent [19]

Henzel et al.

[11] Patent Number: 4,916,112

[45] **Date of Patent: *Apr. 10, 1990**

[54] SLIPPING LAYER CONTAINING PARTICULATE ESTER WAX FOR DYE-DONOR ELEMENT USED IN THERMAL DYE TRANSFER

[75] Inventors: Richard P. Henzel, Webster; Noel R. Vanier, Rochester, both of N.Y.

[73] Assignee: Eastman Kodak Company, Rochester, N.Y.

[*] Notice: The portion of the term of this patent subsequent to Sept. 12, 2006 has been disclaimed.

[21] Appl. No.: 373,748

[22] Filed: Jun. 30, 1989

[51] Int. Cl.[4] ..... B41M 5/35; B41M 5/26

[52] U.S. Cl. ..... 503/227; 8/471; 427/256; 428/327; 428/341; 428/484; 428/488.4; 428/913; 428/914

[58] Field of Search ..... 8/471; 427/256; 428/195, 323, 327, 341, 342, 484, 488.1, 488.4, 913, 914; 503/227

[56] References Cited

U.S. PATENT DOCUMENTS

| | | | |
|---|---|---|---|
| 4,717,711 | 1/1988 | Vanier et al. | 503/227 |
| 4,717,712 | 1/1988 | Harrison et al. | 503/227 |
| 4,829,050 | 5/1989 | Henzel et al. | 503/227 |
| 4,866,026 | 9/1989 | Henzel et al. | 503/227 |

*Primary Examiner*—Pamela R. Schwartz
*Attorney, Agent, or Firm*—Harold E. Cole

[57] ABSTRACT

A dye-donor element for thermal dye transfer comprising a support having on one side thereof a dye layer and on the other side a slipping layer comprising an organic lubricating material in a binder, the lubricating material comprising a nonhomogenous layer of a particulate ester wax comprising an ester of a fatty acid having at least 10 carbon atoms and a monohydric alcohol having at least 6 carbon atoms, the ester wax having a particle size of from about 0.5 μm to about 20 μm.

19 Claims, No Drawings

SLIPPING LAYER CONTAINING PARTICULATE ESTER WAX FOR DYE-DONOR ELEMENT USED IN THERMAL DYE TRANSFER

This invention relates to dye-donor elements used in thermal dye transfer, and more particularly to the use of a certain particulate ester wax slipping layer on the back side thereof to prevent various printing defects and tearing of the donor element during the printing operation.

In recent years, thermal transfer systems have been developed to obtain prints from pictures which have been generated electronically from a color video camera. According to one way of obtaining such Prints, an electronic picture is first subjected to color separation by color filters. The respective color-separated images are then converted into electrical signals. These signals are then operated on to produce cyan, magenta and yellow electrical signals. These signals are then transmitted to a thermal printer. To obtain the print, a cyan, magenta or yellow dye-donor element is placed face-to-face with a dye-receiving element. The two are then inserted between a thermal printing head and a platen roller. A line-type thermal printing head is used to apply heat from the back of the dye-donor sheet. The thermal printing head has many heating elements and is heated up sequentially in response to the cyan magenta and yellow signals. The process is then repeated for the other two colors. A color hard copy is thus obtained which corresponds to the original picture viewed on a screen. Further details of this process and an apparatus for carrying it out are contained in U.S. Pat. No. 4,621,271 by Brownstein entitled "Apparatus and Method For Controlling A Thermal Printer Apparatus," issued Nov. 4, 1986, the disclosure of which is hereby incorporated by reference.

A problem has existed with the use of dye-donor elements for thermal dye-transfer printing because a thin support is required in order to provide effective heat transfer. For example, when a thin polyester film is employed, it softens when heated during the printing operation and then sticks to the thermal printing head, preventing donor transport. A slipping layer is typically provided to facilitate passage of the dye-donor under the thermal printing head. A defect in the performance of that layer causes intermittent rather than continuous transport across the thermal head. The dye transferred thus does not appear as a uniform area, but rather as a series of alternating light and dark bands (chatter marks).

Another defect called "smiles", which are crescent shaped low density areas, is produced in the receiving element by stretch-induced folds in the dye-donor.

Another defect is produced in the receiving element when abraded or melted debris from the back of the dye-donor builds up on the thermal head and causes steaks parallel to the travel direction and extending over the entire image area.

Another defect called "pops" occurs when printing images that have lines or edges parallel to the heat-line of the print head. This results in a significant number of heater elements across the head changing from hot to cold at the same time. These sudden hot to cold transitions may result in sticking of the thermal head to the donor and a jerking motion. The jerking motion causes skipped printing lines and misregistration of the image usually results. At times, the release of this sticking may be so severe as to create a popping noise, or "pops". It would be desirable to eliminate or lessen the above such problems in order to have a commercially acceptable system.

U.S. Pat. Nos. 4,717,711 and 4,717,712 disclose the use of carnauba wax in a slipping layer in thermal dye transfer systems. The particular carnauba wax disclosed therein was coated from solution as a homogenous layer, however. As will be shown by comparative tests hereinafter, the slipping layer of the invention comprising a nonhomogenous layer of particulate ester wax of relatively small particle size has improved slipping performance and a lessened tendency to accumulate on the thermal printhead.

U.S. Pat. No. 4,866,026 issued Sept. 12, 1989, relates to the use of certain functionalized siloxanes along with certain waxes for use as a slipping layer in thermal dye transfer systems. As will be shown by comparative tests hereinafter, the slipping layer of the invention has improved raw stock keeping.

Accordingly, this invention relates to a dye-donor element for thermal dye transfer comprising a support having on one side thereof a dye layer and on the other side a slipping layer, and wherein the slipping layer comprises an organic lubricating material in a binder, the lubricating material comprising a nonhomogenous layer of a particulate ester wax comprising an ester of a fatty acid having at least 10 carbon atoms and a monohydric alcohol having at least 6 carbon atoms, the ester wax having a particle size of from about 0.5 μm to about 20 μm.

Any binder may also be used in the slipping layer of the invention provided it will be useful for the intended effect. In a preferred embodiment, polymeric thermoplastic binders are employed. Examples of such materials include, for example, Poly(styrene-co-acrylonitrile) (70/30 wt. ratio); poly(vinyl alcohol-co-butyral) (available commercially as Butvar 76 ® by Monsanto Corp.); poly(vinyl alcohol-co-acetal); poly(vinyl alcohol-co-benzal); polystyrene; poly(vinyl acetate); cellulose acetate butyrate; cellulose acetate propionate; cellulose acetate; ethyl cellulose; cellulose triacetate; poly(methylmethacrylate); copolymers of methyl methacrylate; etc. In another preferred embodiment of the invention, the thermoplastic binder is cellulose acetate propionate.

The amount of the binder employed in the slipping layer of the invention is not critical. In general, the binder may be employed in an amount of from about 0.1 to about 2 $g/m^2$.

Generally speaking, a wax is a substance which is a solid at ambient temperature and which has a low viscosity at just above its melting point. Examples of fatty acids having at least 10 carbon atoms employed in the ester wax of the invention include lauric, myristic, palmitic, stearic, oleic, linolenic, lignoceric, ricinoleic, cerotic, and behenic. Examples of monohydric alcohols having at least 6 carbon atoms employed in the ester wax of the invention include lauryl, cetyl, myricyl, ceryl, linoleyl, linolenyl, palmityl, capryl, 1 -hexanol, hexenol, 2 -octanol, triacontanol and hexacosanol.

In a preferred embodiment of the invention, the ester wax employed may be carnauba wax, rice bran wax, montan wax or candellila wax, provided it has the particle size as noted above. In a preferred embodiment of the invention, the particle size of the wax ranges from about 1 μm to about 7 μm.

The ester wax may be employed in the invention at any concentration useful for the intended purpose. In general, good results have been 5 obtained at a concentration of from about 0.01 to about 0.4 g/m$^2$.

In a preferred embodiment of the invention, the ester wax is coated from a solvent in which the binder is soluble and the ester wax is insoluble. The ester wax should remain insoluble in the solvent so that it may be retained as discrete particles in a nonhomogenous layer. Such solvents include acetone, butanone, ethyl acetate, alcohols or alcohol-derived solvent mixtures.

U.S. Pat. No. 4,829,050 discloses various solid or liquid organic lubricants used in a slipping layer. Such materials are also useful in the slipping layer of this invention and the above patent is hereby incorporated by reference.

Any dye can be used in the dye layer of the dye-donor element of the invention provided it is transferable to the dye-receiving layer by the action of heat. Especially good results have been obtained with sublimable dyes. Examples of sublimable dyes include anthraquinone dyes, e.g., Sumikalon Violet RS ® (Sumitomo Chemical Co., Ltd.), Dianix Fast Violet 3R FS ® (Mitsubishi Chemical Industries, Ltd.), and Kayalon Polyol Brilliant Blue N BGM ® and KST Black 146 ® (Nippon Kayaku Co., Ltd.); azo dyes such as Kayalon Polyol Brilliant Blue BM ®, Kayalon Polyol Dark Blue 2BM ®, and KST Black KR ® (Nippon Kayaku Co., Ltd.), Sumickaron Diazo Black 5G ® (Sumitomo Chemical Co., Ltd.), and Miktazol Black 5GH ® (Mitsui Toatsu Chemicals, Inc.); direct dyes such as Direct Dark Green B ® (Mitsubishi Chemical Industries, Ltd.) and Direct Brown M ® and Direct Fast Black D ® (Nippon Kayaku Co. Ltd.); acid dyes such as Kayanol Milling Cyanine 5R ® (Nippon Kayaku Co. Ltd.); basic dyes such as Sumicacryl Blue 6G ® (Sumitomo Chemical Co., Ltd.), and Aizen Malachite Green ® (Hodogaya Chemical Co., Ltd.);

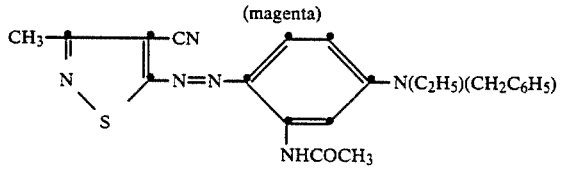

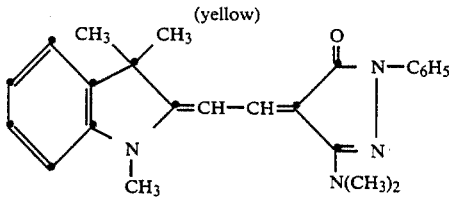

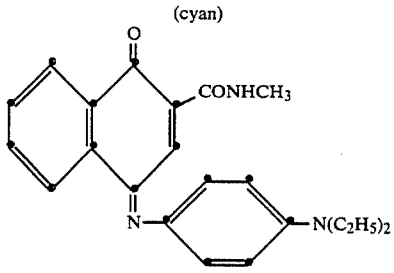

or any of the dyes disclosed in U.S. Pat. No. 4,541,830, the disclosure of which is hereby incorporated by reference. The above dyes may be employed singly or in combination to obtain a monochrome. The dyes may be used at a coverage of from about 0.05 to about 1 g/m$^2$ and are preferably hydrophobic.

A dye-barrier layer may be employed in the dye-donor elements of the invention to improve the density of the transferred dye. Such dye-barrier layer materials include hydrophilic materials such as those described and claimed in U. S. Pat. No. 4,716,144 by Vanier, Lum and Bowman.

The dye in the dye-donor element of the invention is dispersed in a polymeric binder such as a cellulose derivative, e.g., cellulose acetate hydrogen phthalate, cellulose acetate, cellulose acetate propionate, cellulose acetate butyrate, cellulose triacetate or any of the materials described in U.S. Pat. No. 4,700,207 of Vanier and Lum; a polycarbonate; poly(styrene to acrylonitrile), a poly(sulfone) or a poly(phenylene oxide). The binder may be used at a coverage of from about 0.1 to about 5 g/m$^2$.

The dye layer of the dye-donor element may be coated on the support or printed thereon by a printing technique such as a gravure process.

Any material can be used as the support for the dye-donor element of the invention provided it is dimensionally stable and can withstand the heat of the thermal printing heads. Such materials include polyesters such as poly(ethylene terephthalate); polyamides; polycarbonates; glassine paper; condenser paper; cellulose esters such as cellulose acetate; fluorine polymers such as polyvinylidene fluoride or poly(tetrafluoroethylene-co-hexafluoropropylene); polyethers such as polyoxymethylene; polyacetals; polyolefins such as polystyrene, polyethylene, polypropylene or methylpentane polymers; and polyimides such as polyimide amides and polyetherimides. The support generally has a thickness of from about 2 to about 30 μm. It may also be coated with a subbing layer, if desired, such as those materials described in U S. Pat. No. 4,695,288 or U.S. Pat. No. 4,737,486 or the following polymers:

Poly(n-butyl acrylate-co-2-aminoethyl methacrylate hydrochloride-co-2-hydroxyethyl methacrylate-co-methylene bis acrylamide) (50/15/30/5, 50/10/35/5, 50/10/35/5 wt ratio);

Poly(n-butyl acrylate-co-2-aminoethyl methacrylate hydrochloride-co-2 -hydroxyethyl methacrylate-co-ethylene-glycol dimethacrylate) (50/15/30/5, 0/10/35/5, 50/5/40/5 wt ratio);

Poly(n-butyl acrylate-co-2-aminoethyl methacrylate-co-2-hydroxyethyl methacrylate) (50/15/30/5, 50/10/35/5, 50/5/40/5 wt ratio);

Poly(n-butyl acrylate-co-3-aminopropyl-methacrylamide-co-2 -hydroxyethyl methacrylate) (50/5/45, 35/15/50, 50/15/35 wt ratio).

Poly(n-butyl acrylate-co-3-aminopropyl-methacrylamide-co-2-hydroxy ethylacrylate) (50/5/45, 5/15/50 wt ratio).

The dye-receiving element that is used with the dye-donor element of the invention usually comprises a support having thereon a dye image receiving layer. The support may be a transparent film such as a poly(ether sulfone), a Polyimide, a cellulose ester such as cellulose acetate, a Poly(vinyl alcohol-co-acetal) or a poly(ethylene terephthalate). The support for the dye-receiving element may also be reflective such as baryta-coated paper, polyethylene-coated paper, white Polyester (polyester with white pigment incorporated therein), an ivory paper, a condenser paper or a synthetic paper such as duPont Tyvek ®.

The dye image-receiving layer may comprise, for example, a polycarbonate, a polyurethane, a polyester, polyvinyl chloride, poly(styrene-co-acrylonitrile), poly(caprolactone) or mixtures thereof. The dye image-receiving layer may be present in any amount which is effective for the intended purpose. In general, good results have been obtained at a concentration of from about 1 to about 5 g/m$^2$.

As noted above, the dye donor elements of the invention are used to form a dye transfer image. Such a process comprises imagewise heating a dye-donor element as described above and transferring a dye image to a dye receiving element to form the dye transfer image.

The dye donor element of the invention may be used in sheet form or in a continuous roll or ribbon. If a continuous roll or ribbon is employed, it may have only one dye or may have alternating areas of other different dyes, such as sublimable cyan and/or magenta and/or yellow and/or black or other dyes. Such dyes are disclosed in U. S. Pat. Nos. 4,541,830; 4,698,651; 4,695,287; 4,701,439; 4,757,046; 4,743,582; 4,769,360 and 4,753,922, the disclosures of which are hereby incorporated by reference. Thus, one-, two-, three- or four-color elements (or higher numbers also) are included within the scope of the invention.

In a preferred embodiment of the invention, the dye-donor element comprises a poly(ethylene terephthalate) support coated with sequential repeating areas of yellow, cyan and magenta dye, and the above process steps are sequentially performed for each color to obtain a three-color dye transfer image. Of course, when the process is only performed for a single color, then a monochrome dye transfer image is obtained.

Thermal printing heads which can be used to transfer dye from the dye-donor elements of the invention are available commercially. There can be employed, for example, a Fujitsu Thermal Head (FTP-040 MCSOOl), a TDK Thermal Head F415 HH7-1089 or a Rohm Thermal Head KE 2008-F3.

A thermal dye transfer assemblage of the invention comprises (a) a dye-donor element as described above, and (b) a dye-receiving element as described above, the dye receiving element being in a superposed relationship with the dye donor element so that the dye layer of the donor element is in contact with the dye image-receiving layer of the receiving element.

The above assemblage comprising these two elements may be preassembled as an integral unit when a monochrome image is to be obtained. This may be done by temporarily adhering the two elements together at their margins. After transfer, the dye-receiving element is then peeled apart to reveal the dye transfer image.

When a three-color image is to be obtained, the above assemblage is formed on three occasions during the time when heat is applied by the thermal printing head. After the first dye is transferred, the elements are peeled apart. A second dye-donor element (or another area of the donor element with a different dye area) is then brought in register with the dye-receiving element and the process repeated. The third color is obtained in the same manner.

The following examples are provided to illustrate the invention.

EXAMPLE 1

Preparation of Waxes in Micronized Form

Most waxes as provided by the manufacturer or supplier are not in the desired "micronized" or particulate form and as such must be converted. Wax 5 below was supplied in a particulate form and was used as supplied. Waxes 1 to 4 below were modified as follows:

The wax (44.4 g) was heated to 120° C. and added to a hot solution of water (311. ml) containing 10% Alkanol XC® dispersing agent (duPont Company) (44.4 g) at 95° C. It was dispersed with a Brinkmann Mixer equipped with a 20 mm head for 5 min at 10,000 rpm, cooled, diluted with 2-3X volume of methanol and then filtered. The solid was washed with methanol and residual solvent was stripped in a vacuum oven to give a solid mass of wax particles 6–9 μg in diameter suitable for coating.

EXAMPLE 2

A dye-donor element of alternating sequential areas of cyan, magenta and yellow dye was prepared by coating on a 6 μm poly(ethylene terephthalate) support:

(1) a subbing layer of a titanium alkoxide (duPont Tyzor TBT®) (0.12 g/m$^2$) from a n-propyl acetate and n-butyl alcohol solvent mixture, and (2) a dye layer containing the cyan dye illustrated above (0.42 g/m$^2$), the magenta dye illustrated above (0.23 g/m$^2$) and the yellow dye illustrated above (0.21 g/m$^2$) in a cellulose acetate propionate (2.5% acetyl, 45% propionyl) binder (0.66 g/m$^2$) coated from a toluene, methanol and cyclopentanone solvent mixture. The cyan dye layer also contained S 363® (Shamrock Technologies, Inc.) micronized blend of polyethylene, polypropylene, and oxidized polyethylene particles (0.02 g/m$^2$).

On the back side of the dye-donor was coated:

(1) a subbing layer of a titanium alkoxide (duPont Tyzor TBT®) (0.12 g/m$^2$coated from a n-propyl acetate and n-butyl alcohol solvent mixture, and (2) a slipping layer of the particulate ester wax or control material as indicated in Table 1 in a cellulose acetate propionate binder (2.5% acetyl, 45% propionyl) (0.54 g/m$^2$) coated from a toluene, methanol and cyclopentanone solvent mixture.

Invention Particulate Ester Waxes

Wax 1: Carnauba wax (Kodak Laboratory and Research Products, No. 1306), a commercial wax, approximately 85% aliphatic and aromatic esters, predominately myricyl cerotate. For the purposes of this test, the wax was micronized as described above to give particles of 6–9 μm diameter. Melting range: 81°–86° C.

Wax 2: Montan wax (Bleached Montan Wax, Frank B. Ross Co.), a mineral wax of 62–68 wt. % long chain $C_{24}$–$C_{30}$ esters containing terpenes and derived from lignite. This was micronized as described above to give particles of 6–9 μm diameter. Melting range: 74°–79° C.

Wax 3: Candelilla wax (Reined Candelilla Wax, Flakes, Frank B. Ross Co.). a vegetable wax of approximately 29% esters and containing 50% hydrocarbons. This wax was micronized as described above to give Particles of 6–9 μm diameter. Melting range: 68°–72° C.

Wax 4: Rice bran wax (Ross rice bran wax, Frank B. Ross Co.), a natural vegetable wax composed primarily of esters of lignoceric and behenic acids. This wax was micronized as described above to give particles of 6–9 μm diameter. Melting range: 79°–83° C.

Wax 5: S-Nauba® (Shamrock Technologies, Inc.) No. 5021 carnauba wax. This is considered chemically equivalent to Wax 1 but is from a different supplier and provided as particles of approximately 13 μm diameter. Controls waxes or other materials that were evaluated were as follows:

Control 1: Paraffin wax (Fisher Scientific) A hydrocarbon wax of m.p. 63° C.

Control 2: Octacosane (Kodak Laboratory & Research Products No. 9823) A $C_{28}H_{58}$ straight chain hydrocarbon. Melting range: 62°±2° C.

Control 3: Polyethylene wax S-394N1® (Shamrock Technologies, Inc.) A micronized polyethylene wax of 5 μm av. particle diameter of m.p. 113° C.

Control 4 Amide wax S 400N1 (Shamrock Technologies, Inc.) A particulate ethylene bisstearamide wax estimated to melt at approximately 140° C. Control 5: Polyethylene MPP620VF (Micropowders, Inc.) A polyethylene micropowder of approximately 2.5 μm average particle diameter, m.p. 116° C.

Control 6: Fluo-HT® Fluocarbon powder (Micropowders Inc.) A micronized polytetrafluoroethylene of 2 μm average particle diameter.

A dye-receiving element was prepared by coating the following layers in the order recited on a titanium dioxide pigmented polyethylene-overcoated paper stock which was subbed with a layer of Poly(acrylonitrile-co-vinylidene chloride-co-acrylic acid) (14:79:7 wt. ratio) (0.08 g/m²) coated from 2-butanone:

(1) Dye-receiving layer of Makrolon 5705® (Bayer AG Corporation) polycarbonate resin (2.9 g/m²), Tone PCL 300®

Polycaprolactone (Union Carbide) (0.38 g/m²). and 1,4-didecoxy-2,6-dimethoxyphenol (0.38 g/m²) coated from methylene chloride; and (2) Overcoat layer of Tone PCL 300® polycaprolactone (Union Carbide) (0.11g/m²), FC 431® surfactant (3M Corp.) (0.016 g/m²) and DC-510® surfactant (Dow Corning) (0.016 g/m²) coated from methylene chloride.

The dye side of the dye-donor element strip approximately 10 cm×13 cm in area was placed in contact with the dye image-receiving layer of the dye-receiver element of the same area. The assemblage was lamped to a stepper-motor driven 60 mm diameter rubber roller and a TDK Thermal Head (No. L-231) (thermostatted at 23.5° C.) was pressed with a force of 8.0 pounds (3.6 kg) against the dye-donor element side of the assemblage pushing it against the rubber roller.

The imaging electronics were activated causing the donor/receiver assemblage to be drawn between the printing head and roller at 6.9 mm/sec. Coincidentally, the resistive elements in the thermal print head were pulsed for 29 μsec/pulse at 128 μsec intervals during the 33 msec/dot printing time. A stepped density image was generated by incrementally increasing the number of pulses/dot from 0 to 255. The voltage supplied to the printing head was approximately 24.5 volts, resulting in an instantaneous peak power of 1.4 watts/dot and maximum total energy of 10.5 mJoules/dot.

Stepped density individual cyan, magenta and yellow images of each dye were obtained by printing from the three dye-donors. The quality of print was observed and is recorded below.

A separate cyan test pattern at maximum density was also generated. The force required for the pulling device to draw the assemblage between the print head and roller was measured using a Himmelstein Corp. 3-08TL(16-1) Torquemeter® (10 inch lb. range) and 6-205 Conditioning Module®. The force was tabulated during printing of the D-max area A low force is desirable to minimize image defects. The following results were obtained:

TABLE 1

| Material in Binder (g/m²) | Print Quality | Force (lbs) |
|---|---|---|
| None | Did not transport through head | >6 |
| Control 1 (0.032) | Many defects, stuck to head at start | >6 |
| Control 2 (0.032) | Several small defects | 2.9 |
| Control 3 (0.032) | Many defects, stuck to head at start | 3.7 |
| Control 4 (0.032) | Many defects, noise, stuck to head | >6 |
| Control 5 (0.032) | Did not transport through head | >6 |
| Control 6 (0.032) | Many defects, noise, stuck to head | 3.4 |
| Wax 1 (0.032) | Good quality | 1.1 |
| Wax 2 (0.032) | Good quality | 1.0 |
| Wax 3 (0.032) | Good quality | 1.2 |
| Wax 4 (0.032) | Good quality | 1.3 |
| Wax 5 (0.032) | Good quality | 1.0 |
| Wax 1 (0.0054) | Some defects, noise, stuck to head | 2.0 |
| Wax 1 (0.011) | A few defects some noise | 1.6 |
| Wax 1 (0.022) | Good quality | 1.4 |
| Wax 1 (0.048) | Occasional sticking upon printing yellow | 1.2 |
| Wax 1 (0.097) | Good quality | 1.0 |
| Wax 1 (0.19) | Good quality | 1.4 |

The above results indicate that the slipping layer according to the invention gave superior performance as compared to the control materials.

EXAMPLE 2

This example is similar to Example 1, but shows the additional benefits obtained when an ester wax such as carnauba wax is added to a slipping layer:

(a) that uses a non-cellulosic binder rather than the cellulosic binder of Example 1, (b) that uses a fluorocarbon solid lubricant in a cellulosic binder, and (c) that uses a fluorocarbon solid lubricant in a cellulose nitrate binder.

Dye-donors were prepared as in Example 1 with the following changes in the slipping layers:

(a) Wax 5 (0.032 g/m²) was added to a non-cellulosic binder (0.54 g/m²) of styrene acrylonitrile (70:30 wt. ratio) Tyril 880® (Dow Chemical Co.), (b) Wax 5 (0.032 g/m²) was added to fluorocarbon Control 6 of Example 1 (0.11 g/m²) in the cellulose acetate propionate binder of Example 1 (0.54 g/m²), and (c) Wax 5 (0.032 g/m²) was added to Emralon 329® (Acheson Colloids), a dry film lubricant of polytetrafluoroethylene in a cellulose nitrate binder (0.54 g.m²)

Each of the above coatings had a corresponding control where no wax was added to the slipping layer.

Dye receivers were prepared as in Example 1.

The evaluation for print quality and relative force for passage through the thermal head was done as in Example 1. The following results were obtained:

TABLE 2

| Material in Layer (g/m$^2$) | Print Quality | Force (lbs) |
|---|---|---|
| Styrene-acrylonitrile (control) | Many defects, noise, stuck to head | 3.7 |
| Styrene-acrylonitrile with Wax 5 | good quality | 1.3 |
| Fluorocarbon in cellulose ester (control) | Many defects, noise, stuck to head | 3.4 |
| Fluorocarbon in cellulose ester with Wax 5 | good quality | 1.2 |
| Fluorocarbon in cellulose nitrate (control) | good quality | 1.2 |
| Fluorocarbon in cellulose nitrate with Wax 5 | good quality | 1.0 |

The above results show that improved performance is obtained by the addition of a particulate ester wax in accordance with the invention.

The invention has been described in detail with particular reference to preferred embodiments thereof, but it will be understood that variations and modifications can be effected within the spirit and scope of the invention.

What is claimed is:

1. In a dye-donor element for thermal dye transfer comprising a support having on one side thereof a dye layer and on the other side a slipping layer comprising an organic lubricating material in a binder, the improvement wherein said lubricating material comprises a nonhomogenous layer of a particulate ester wax comprising an ester of a fatty acid having at least 10 carbon atoms and a monohydric alcohol having at least 6 carbon atoms, said ester wax having a particle size of from about 0.5 μm to about 20 μm.

2. The element of claim 1 wherein said ester wax is coated from a solvent in which said binder is soluble and said ester wax is insoluble.

3. The element of claim 1 wherein said ester wax has a particle size of from about 1 μm to about 7 μm.

4. The element of claim 1 wherein said ester wax is present in an amount of from about 0.01 to about 0.4 g/m$^2$.

5. The element of claim 1 wherein said ester wax is carnauba wax.

6. The element of claim 1 wherein said ester wax is rice bran wax.

7. The element of claim 1 wherein said ester wax is montan wax.

8. The element of claim 1 wherein said ester wax is candellila wax.

9. In a process of forming a dye transfer image comprising (a) imagewise-heating a dye-donor element comprising a support having on one side thereof a dye layer and on the other side a slipping layer comprising an organic lubricating material in a binder, and (b) transferring a dye image to a dye receiving element to form said dye transfer image, the improvement wherein said lubricating material comprises a nonhomogenous layer of a particulate ester wax comprising an ester of a fatty acid having at least 10 carbon atoms and a monohydric alcohol having at least 6 carbon atoms, said ester wax having a particle size of from about 0.5 μm to about 20μm.

10. The process of claim 9 wherein said ester wax is coated from a solvent in which said binder is soluble and said ester wax is insoluble.

11. The process of claim 9 wherein said ester wax has a particle size of from about 1 μm to about 7 μm.

12. The process of claim 9 wherein said ester wax is present in an amount of from about 0.01 to about 0.4 g/m$^2$.

13. The process of claim 9 wherein said ester wax is carnauba wax, rice bran wax, montan wax or candellila wax.

14. The process of claim 9 wherein said support is poly(ethylene terephthalate) which is coated with sequential repeating areas of cyan, magenta and yellow dye, and said process steps are sequentially performed for each color to obtain a three-color dye transfer image.

15. In a thermal dye transfer assemblage comprising:

(a) a dye-donor element comprising a support having on one side thereof a dye layer and on the other side a slipping layer comprising an organic lubricating material in a binder, and (b) a dye receiving element comprising a support having thereon a dye image-receiving layer, said dye-receiving element being in a superposed relationship with said dye-donor element so that said dye layer is in contact with said dye image-receiving layer, the improvement wherein said lubricating material comprises a nonhomogenous layer of a particulate ester wax comprising an ester of a fatty acid having at least 10 carbon atoms and a monohydric alcohol having at least 6 carbon atoms, said ester wax having a particle size of from about 0.5 μm to about 20 μm.

16. The assemblage of claim 15 wherein said ester wax is coated from a solvent in which said binder is soluble and said ester wax is insoluble.

17. The assemblage of claim 15 wherein said ester wax has a particle size of from about 1 μm to about 7 μm.

18. The assemblage of claim 15 wherein said ester wax is present in an amount of from about 0.01 to about 0.4 g/m$^2$.

19. The assemblage of claim 15 wherein said ester wax is carnauba wax, rice bran wax. montan wax or candellila wax.

* * * * *